166-308 SR

5/5/87 XR 4,662,451

United States Patent [19]

Boade

[11] Patent Number: 4,662,451

[45] Date of Patent: May 5, 1987

[54] METHOD OF FRACTURING SUBSURFACE FORMATIONS

[75] Inventor: Rodney R. Boade, Bartlesville, Okla.

[73] Assignee: Phillips Petroleum Company, Bartlesville, Okla.

[21] Appl. No.: 742,665

[22] Filed: Jun. 7, 1985

[51] Int. Cl.[4] ..... E21B 43/26

[52] U.S. Cl. ..... 166/299; 166/63; 166/308; 166/280

[58] Field of Search ..... 166/299, 280, 308, 300, 166/63; 102/313

[56] References Cited

U.S. PATENT DOCUMENTS

| | | | |
|---|---|---|---|
| 2,766,828 | 10/1956 | Rachford, Jr. | 166/299 |
| 2,892,405 | 6/1959 | Chesnut | 166/299 |
| 3,002,454 | 10/1961 | Chesnut | 166/299 |
| 3,083,778 | 4/1963 | Friedman et al. | 166/299 X |
| 3,104,706 | 9/1963 | Eilers et al. | 166/299 |
| 3,174,545 | 3/1965 | Mohaupt | 166/299 |
| 3,280,913 | 10/1966 | Smith | 166/298 |
| 3,336,982 | 8/1967 | Woodward et al. | 166/299 |
| 3,456,589 | 7/1969 | Thomison et al. | 166/299 X |
| 3,566,969 | 3/1971 | Hendrickson | 166/299 |
| 3,587,744 | 6/1971 | Spencer et al. | 166/299 |
| 3,593,793 | 7/1971 | Kelseaux | 166/299 X |
| 3,630,284 | 12/1971 | Fast et al. | 166/299 |
| 3,713,487 | 6/1973 | Lozanski | 166/280 |
| 3,999,803 | 12/1976 | Coursen | 299/4 |
| 4,530,396 | 7/1985 | Mohaupt | 166/63 |

FOREIGN PATENT DOCUMENTS

| | | | |
|---|---|---|---|
| 643201 | 6/1962 | Canada | 166/299 |
| 1292211 | 3/1962 | France | 166/299 |

OTHER PUBLICATIONS

*The Condensed Chemical Dictionary,* 6th Edition, Reinhold Publishing Co., New York, 1961, p. 944.

Howard, G. C. and C. R. Fast, *Hydraulic Fracturing,* New York, Society of Petroleum Engineers of AIME, 1970, pp. 50 and 51.

Hampel, C. A. et al., eds., *The Encyclopedia of Chemistry,* third edition, New York, Van Nostrand Reinhold Co., 1973, pp. 409–411 and pp. 919–921.

*Primary Examiner*—Stephen J. Novosad

*Attorney, Agent, or Firm*—William R. Sharp

[57] ABSTRACT

A method of fracturing subsurface formations is provided which utilizes a mixture of a propellant and a propping agent. According to another aspect a mixture of a combustible material such as a propellant and a propping agent along with another composition which includes a combustible material are deposited in a borehole from a conduit system which is raised continuously through the borehole. After such deposition, the deposited compositions are ignited so as to cause fracturing of the formation around the borehole.

17 Claims, 5 Drawing Figures

METHOD OF FRACTURING SUBSURFACE FORMATIONS

BACKGROUND OF THE INVENTION

This invention relates to a method of fracturing subsurface formations in the vicinity of a borehole.

Fracturing of oil and gas well formations has been successful for the purpose of increasing the flow of petroleum fluids. Such fracturing can be effected by injecting a liquid into the well under sufficient pressure to fracture the formation. This technique is known as hydraulic fracturing. According to another technique, fracturing can be effected by the use of explosives such as ammonium nitrate. Such fracturing techniques as discussed above act to form fissures in the subsurface formation around the well borehole so as to increase the permeability of the formation, thus enhancing oil and/or gas flow from the formation into the borehole. Fractured formations may be further stimulated by forcing a propping agent into the fractures or fissures under pressure. If the propping agent is of sufficient size and strength it has the ability to hold the fractures open so that oil and gas may pass more freely from the formation into the borehole.

According to one particular prior fracturing method disclosed in U.S. Pat. No. 3,713,487 of Lozanski, explosives and propping agents are employed in combination to stimulate the flow of petroleum fluids in a well. More specifically, a high explosive, such as dynamite, together with a propping agent, such as glass beads, are placed in a container provided with a detonator. The container is lowered in the well borehole to a zone where fracturing is desired, and the void space remaining between the container and the borehole walls is filled with a high explosive such as ammonium nitrate. The explosive in the container is then detonated so as to cause fracturing in the subsurface formation around the borehole, the force of the explosion simultaneously forcing propping agent into the fissures thus produced.

High explosives such as dynamite used in the above described method generate an extremely high velocity shock wave upon detonation. This wave generally propagates at a velocity of several thousand meters per second. Such high velocity shock waves cause appreciable damage to rock formations around the borehole. Such damage typically involves packing of rock around the borehole so as to reduce permeability and thus also reduce flow of oil or gas into the borehole.

SUMMARY OF THE INVENTION

It is, therefore, an object of the present invention to provide an improved method of fracturing subsurface formations.

It is also an object of the invention to provide a fracturing method which successfully employs a propping agent, and which avoids the damage associated with high explosives discussed above.

The above objects are realized in a method of fracturing a subsurface formation traversed by a borehole which involves positioning a quantity of a composition in the borehole, wherein the composition includes a mixture of a propellant, hereinafter defined, and a granular propping agent. The composition is ignited to result in multiple fissures radiating from the borehole into the formation.

According to another aspect of the invention, a fracturing method is provided which involves introducing a first composition and a second composition into the borehole, wherein the first composition includes a mixture of a combustible material and a granular propping agent, and the second composition includes a combustible material. The compositions are released simultaneously from an open end of a conduit system as it is continuously raised through the borehole. Each composition is positioned in the borehole so as to occupy separate but closely adjacent volumes. The compositions are then ignited to form multiple fissures in the formation accordingly. According to a preferred embodiment, the first composition is positioned generally coaxially within the borehole and the second composition is positioned so as to surround the first composition.

Use of the propellant according to one aspect of the invention causes much less damage in the formation immediately surrounding the borehole than in the case of the above discussed high explosives. Furthermore, according to the other aspect of the invention, a simple technique of filling the borehole with two separate compositions is provided which requires no containers for containing either of the compositions.

DETAILED DESCRIPTION OF THE DRAWINGS

Figure 1:
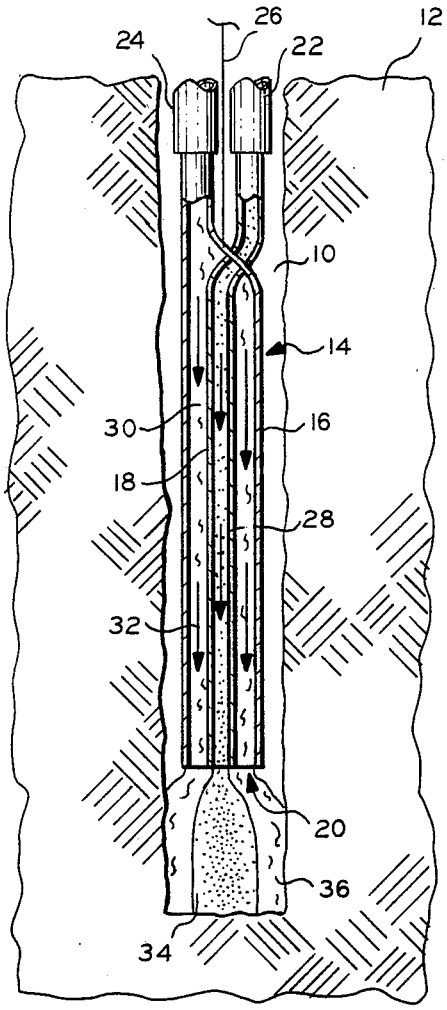
FIG. 1 is a partial sectional view of a borehole having a conduit system therein for depositing slurry-like compositions, hereinafter described.

A preferred embodiment of the invention will now be described with reference to the drawings in the environment of an oil or gas well. It should be understood, however, that the method described herein is suitable for other applications such as for enhancing flow in geothermal reservoirs, for preparing in-situ oil shale retorts, for increasing gas drainage rates from coal seams, for creating flow paths in mineral deposits for solution mining, and for a variety of other applications which require fracturing of subsurface formations.

First, two separate compositions are prepared according to the present invention for subsequent deposition in a borehole. A first composition includes a mixture of a propellant and a propping agent. As used herein and in the appended claims, the term "propellant" is defined as a combustible material characterized by a reaction rate which increases approximately in direct proportion to pressure, and which has an associated pressure-time (commonly referred to as P-t) curve which exhibits a maximum pressure below about 50,000 psi. In addition, propellants are characterized by reaction times on the order of milliseconds, whereas explosives are characterized by reaction times on the order of microseconds. The propellant employed may be a solid, granular propellant. Granular propellants suitable for use with the present invention include many commercially available propellants having as their basic ingredient sodium nitrate, potassium nitrate, nitrocotton, nitrocellulose, potassium perchlorate or mixtures thereof. Propellants which contain sodium nitrate or potassium nitrate are commonly known as "black powders". However, these types of propellants are very dangerous due to their extreme sensitivity to primary ignition sources, particularly spark and flame. Propellants which contain nitrocotton and nitrocellulose are less dangerous, but have the disadvantage of being quite expensive.

Any suitable granular propping agent may be used which has sufficient size and strength to hold fractures open in a subsurface formation. Specific examples of propping agents include sand, glass beads, aluminum particles, ceramic particles, and nut shells. Most preferably, each granule or particle of the propping agent has a diameter of about 0.01 to about 0.1 inch.

The above described first composition is most preferably in the form of a slurry if a granular propellant is used, such that the first composition also contains a liquid carrier, wherein the use of the term "carrier" will become more apparent below. Use of a liquid carrier, among other things, facilitates introduction of the composition into a borehole which will be better understood with reference to FIG. 1. The liquid carrier employed can be one of many fracturing fluids presently used in hydraulic fracturing. Of these fluids, presently preferred liquid carriers include various oils such as crude oil, kerosene, diesel oil, and viscous refined oil such as API no. 5 or no. 6 residual fuel oils. Such oils serve as effective liquid carriers and also have the added advantage of being capable of participating in the combustion reaction with the propellant.

Most preferably, the above described first composition is of a gelatinous consistency in order to enhance the propping agent carrying properties of the slurry and also to minimize diffusion into an adjacent slurry, described below. To achieve such a gelatinous consistency, it may be necessary in the case of thinner refined and crude oils to add a small amount of a thickening agent such as a fatty salt (i.e. Napalm) or a fatty soap, such thickening agents being well known in the art.

By way of example, the first composition can contain the following ingredients in percentages which are expressed as weight percentages: about 30% to about 60% propellant; about 10% to about 40% oil; about 10% to about 30% propping agent; and from about 1% to about 5% thickening agent.

As an alternative to the slurry described above which contains a granular propellant, a liquid propellant can be employed, in which case the liquid carrier would not be necessary. Suitable liquid propellants include a mixture of hydrogen peroxide and alcohol, hydrazine, gasoline, kerosene, or a commercially available product such as RE-FLO® 403, manufactured by Hercules, Inc. of Wilmington, Del. Again, to achieve the desired consistency, a thickening agent would usually be added.

In addition to the first composition, a second composition is prepared which includes a propellant. One of the granular propellants like those discussed with reference to the first composition may be employed, in which case a liquid carrier such as oil and most typically also a thickening agent are added. By way of example, the second composition can include about 40% to 80% propellant, about 20% to about 50% oil, and about 1% to 5% thickening agent. Alternatively, a liquid propellant like one of those discussed above could be used in combination with an appropriate thickening agent. Note that no propping agent is included in the second composition according to this preferred embodiment.

Referring now to FIG. 1, a partial sectional view of a borehole 10 is shown as extending through a subsurface formation 12. it should be noted that only the bottom portion of borehole is shown in FIG. 1. Although not shown, a casing might be employed in the borehole, in which case the casing would have perforations to permit fluid flow therethrough. Most typically borehole 10 is about 7 to about 10 inches in diameter, the largest possible diameter being desirable since this tends to maximize the quantity of propellant which can be deposited therein. A conduit system 14 for depositing the above described compositions is shown as being positioned within borehole 10 during deposition of the compositions. Conduit system 14 includes an outer conduit 16 and an inner conduit 18 which is positioned generally coaxially within conduit 16. Open ends of each of conduit 16 and 18 are substantially flush with one another, and form open end 20 of conduit system 14. The upper ends of conduit 16 and 18 are connected to suitable respective hoses 22 and 24. Hoses 22 and 24 are preferably flexible, and extend through the top (not shown) of borehole 10 to some means of containing a long length of each hose. Such a means might be, for example, a large spool onto which each hose is loosely wound before the conduit system is lowered into the borehole. A suitable strong cable 26 is connected to conduit system 14, and extends up through the top of borehole 10 to an appropriate piece of equipment for lowering and raising conduit system 14 within the borehole.

In operation, conduit system 14 is lowered to near the bottom of borehole 10. The above described first composition is then continuously pumped through hose 22 so as to flow through conduit 18 as schematically indicated at 28. Similarly, the second composition as defined above is continuously pumped through hose 24 so as to flow through the generally annular space 30 defined between conduit 16 and 18. Flow of the second composition through annular space 30 is schematically indicated at 32. At about the same time that pumping of the two compositions is initiated through conduit system 14, movement in a generally upward direction is imparted to conduit system 14 via cable 26. Conduit system 14 is raised continuously through borehole 10 as the two compositions are pumped through the system. Accordingly, each composition exits open end 20 of conduit system 14 simultaneously so as to be introduced into the borehole. The first and second composition so introduced form section 34 and section 36 respectively within borehole 10. As shown, each section occupies a separate but closely adjacent volume in borehole 10. Most preferably, section 34 is positioned generally coaxially in borehole 10, and section 36 is positioned so as to surround section 34 and so as to be concentrically positioned with respect to section 34.

The flow rates of the first and second compositions through conduit system 14, and the rate at which the conduit system is moved upward through the borehole are selected to achieve the desired ratio of first composition to second composition. Most preferably, such flow rates and upward velocity are selected so that section 34 has a diameter equal to about $\frac{2}{3}$ the borehole diameter. This would make the volume occupied by section 34 about $\frac{1}{2}$ of the borehole volume. In addition, the upward velocity of system 14 and flow rates of the compositions are selected so that the approximate upper level of sections 34 and 36 is closely adjacent to open end 20 during depositing of the compositions.

Several techniques are available to place ignition devices in the deposited compositions during deposition. For example, detonation devices (not shown) such as conventional time bomb devices or electrically actuated devices can be emplaced at the bottom of the borehole before the deposition starts, or such devices can be affixed to conduit system 14 and released at some predetermined level as deposition is taking place. Therefore, the ignition or detonation devices would become embedded in the deposited compositions. Most preferably, however, a suitable line charge (not shown) can be embedded in either composition during or after deposition so that an end of the charge extends somewhat below the upper level of deposited sections 34 and 36. An electrical detonator for setting off the line charge is electrically connected to the line charge.

Figure 2:
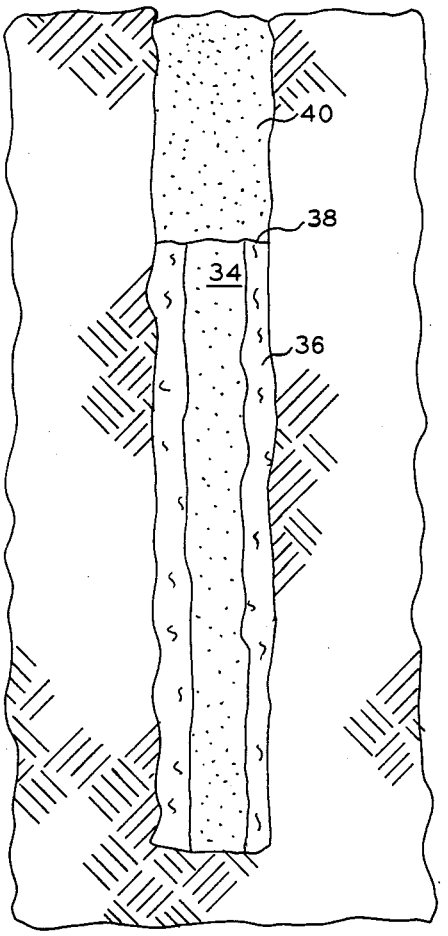
FIG. 2 is a partial sectional view of the borehole of FIG. 1 after the compositions have been deposited, and also after the borehole has been stemmed.

At some predetermined point, flow of the compositions through conduit system 14 is terminated so as to establish the desired height of the sections within borehole 10. Referring to FIG. 2, the upper level of section 34 and 36 is shown at 38.

Next, a portion of the borehole above the column formed by sections 34 and 36 is preferably stemmed so that gases generated upon ignition of the propellant in the compositions will be forced to move into the subsurface formation rather than escape upward through the borehole. This stemming operation preferably involves the introduction of coarse sand into the borehole so as to form a column having a height of, by way of example, about 75% of the length of the column formed by the sections. Or, the stemming sand could simply fill the remaining portion of the borehole. Preferably, a grout or epoxy is combined with the stemming sand either by simply mixing the grout or epoxy with the sand before introduction to the borehole, or by introducing the grout or epoxy into the borehole at different points in the stemming operation. A portion of the resulting stemming column is shown at 40 in FIG. 2.

Figure 3:
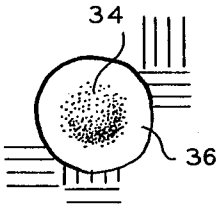
FIG. 3 is a cross-sectional view of the borehole filled with the compositions.

Referring to FIG. 3, a cross sectional view of the borehole is shown having sections 34 and 36 therein.

Figure 5:
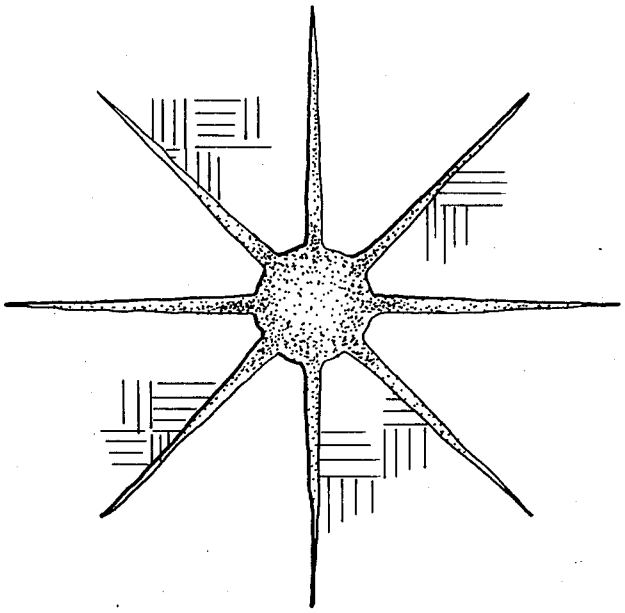
FIG. 5 is a schematic illustration of the borehole and surrounding formation near the end of the fracturing process.
Figure 4:
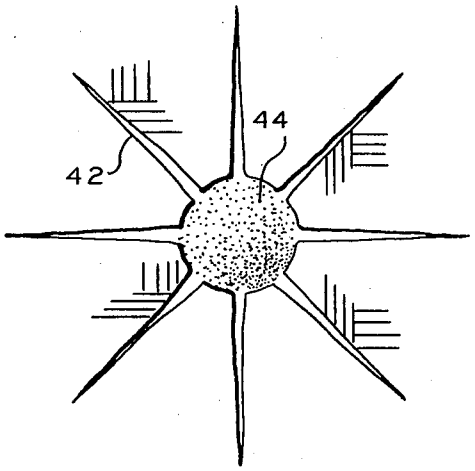
FIG. 4 is a schematic illustration of the borehole and the surrounding subsurface formation during the fracturing process.

Assuming a line charge has been embedded in the upper portion of the column formed by sections 34 and 36, the compositions in each section are ignited by the line charge so as to establish a "burn front" which moves down the column. In general, when using the propellants discussed above, the peak pressure in the borehole will be in the vicinity of about 30,000 to about 40,000 psi, and reaches the peak in about a few tenths of a millisecond to about 5 milliseconds. The pressure load diminishes after the peak pressure is reached, but is typically maintained at about 10,000 psi for several tens of milliseconds. Pressure within the borehole will build rapidly to the point at which many fractures or fissures, as shown schematically at 42 in FIG. 4, are formed along the borehole wall. Gas enters these fractures and extends them. The rate of gas generation is so fast that a single fracture cannot accept all of the gas. Thus, several fractures can be expected to be extended. The actual number of fractures depends on the rate of gas generation. The length of the fractures depends on the total amount of gas produced as well as the number of fractures. Since the propping agent, schematically represented in FIG. 4 at 44, is originally near the borehole axis according to the preferred embodiment, only gas moves into the fractures initially. Later, however, the propping agent from section 34 expands and moves into the fractures which can be seen with reference to FIG. 5. By delaying entry of the propping agent into the fractures in this manner, it is possible to reduce the probability of the propping agent restricting gas flow in the fractures and hence of restricting fracture growth. Once the propellant supply in the borehole has been consumed, the gas pressure will decay and the fractures will move toward closure, but will be held at least partially open by the propping agent.

Use of a propellant in the two compositions employed according to the invention will not cause the appreciable damage in tight packing of rock formations around the borehole which are associated with high explosives. Thus by using a propellant, the permeability of the subsurface formation after fracturing is enhanced.

Obviously, many modifications and variations of the present invention are possible in light of the above teachings. It is therefore to be understood that within the scope of the appended claims the invention may be practiced otherwise than as specifically described. For example, according to certain aspects of the present invention as previously described, combustible materials other than propellants may be used. In addition, although the two sections deposited in the boreholes are positioned in a concentric arrangement in the preferred embodiment, it is conceivable that nonconcentric arrangements could be employed in certain situations.

What is claimed is:

1. A method of fracturing a subsurface formation which is traversed by a borehole comprising:

positioning within said borehole a quantity of a first composition which includes a mixture of a propellant and a granular propping agent, said first composition as positioned forming a first section;

positioning a second composition, which includes a propellant, in said borehole so as to occupy a volume separate from and closely adjacent to that volume occupied by said first composition, wherein said second composition as so positioned forms a second section;

said first and second sections being positioned in said borehole by introducing said first and second compositions simultaneously into said borehole;

igniting said first composition and said second composition to thereby form multiple fissures radiating from said borehole into said formation.

2. A method as recited in claim 1, wherein said propellant is a solid, granular propellant.

3. A method as recited in claim 2, wherein said granular propellant contains a basic ingredient selected from the group consisting of sodium nitrate, potassium nitrate, nitrocotton, nitrocellulose, potassium perchlorate, and mixtures thereof.

4. A method as recited in claim 2, wherein said first composition further includes a liquid carrier.

5. A method as recited in claim 4, wherein said liquid carrier is an oil.

6. A method as recited in claim 1, wherein said sections are positioned such that said second section generally surrounds said first section.

7. A method as recited in claim 6, wherein said sections are positioned such that said first section is generally coaxially positioned within said borehole, and wherein said second section is concentrically positioned with respect to said first section.

8. A method as recited in claim 7, wherein the propping agent is selected from the group consisting of sand, aluminum particles, ceramic particles, glass beads, and nutshells.

9. A method as recited in claim 1, wherein said propellant is a liquid propellant.

10. A method as recited in claim 9 wherein said liquid propellant is selected from the group consisting of hydrazine, gasoline and kerosene.

11. A method of fracturing a subsurface formation which defines a borehole therethrough comprising:

introducing a first composition and a second composition into said borehole, said first composition including a mixture of a combustible material and a granular propping agent and said second composition including a combustible material, wherein said compositions are released simultaneously from an open end of a conduit system as it is continuously raised through said borehole such that said first composition is positioned in said borehole so as to occupy a volume separate from and closely adjacent to that volume occupied by said second composition; and igniting said compositions to thereby form multiple fissures radiating from said borehole into said formation.

12. A method as recited in claim 11, wherein said conduit system includes an outer conduit and an inner conduit positioned generally coaxially within said outer conduit such that a generally annular space is defined between said conduits, and wherein said first composition is passed through said inner conduit and said second composition is passed through said annular space between said conduits.

13. A method as recited in claim 12, wherein said combustible material in at least one of said compositions is a solid, granular propellant.

14. A method as recited in claim 13, wherein said one composition further includes a liquid carrier.

15. A method as recited in claim 12, wherein said first composition as positioned in said borehole forms a first section and said second composition as positioned in said borehole forms a second section, said first section being generally coaxially positioned within said borehole, and wherein said second section is concentrically positioned with respect to said first section so as to surround said first section.

16. A method as recited in claim 12, wherein said first composition as deposited in said borehole forms a first section, and wherein said first section has a diameter about $\frac{2}{3}$ of the borehole diameter.

17. A method as recited in claim 12, wherein said combustible material in at least one of said compositions is a liquid propellant.

* * * * *